United States Patent [19]

Flämig et al.

[11] Patent Number: 4,944,089

[45] Date of Patent: Jul. 31, 1990

[54] MOUNTING A PRESS SHELL TO A PRESS ROLL FOR DEWATERING A WEB

[75] Inventors: Hans Flämig, Heidenheim; Andreas Schütte, Steinheim; Christian Schiel, Heidenheim; Karl Steiner, Herbrechtingen; Josef Müllner, Heidenheim, all of Fed. Rep. of Germany

[73] Assignee: J. M. Voith GmbH, Fed. Rep. of Germany

[21] Appl. No.: 428,639

[22] Filed: Oct. 30, 1989

Related U.S. Application Data

[62] Division of Ser. No. 267,023, Nov. 4, 1988, Pat. No. 4,878,281.

[30] Foreign Application Priority Data

Feb. 20, 1988 [DE] Fed. Rep. of Germany ..... 3805350

[51] Int. Cl.[5] ..... B21D 31/00

[52] U.S. Cl. ..... 29/895.22; 29/513; 29/525.1; 29/116.1

[58] Field of Search ..... 29/148.4 D, 509, 513, 29/525.1, 116.1, 118, 119, 123, 129, 129.5; 100/173, 176

[56] References Cited

U.S. PATENT DOCUMENTS 2,768,725 10/1956 Foulds et al. ..... 29/513

4,317,270 3/1982 Watanabe et al. ..... 29/148.4 D

*Primary Examiner*—P. W. Echols

*Assistant Examiner*—Irene Cuda

*Attorney, Agent, or Firm*—Ostrolenk, Faber, Gerb & Soffen

[57] ABSTRACT

A press roll for a web includes a support body which is either stationary or rotatable and a press shell which is rotatable over the support body and against a mating roll. A respective shell support element or disc is disposed axially outward of both ends of the support body and the support element has an axially outward, face side. The flexible, liquid impervious endless belt press shell has lateral edge zones. Each edge zone has a respective plurality of outwardly projecting tongues and has cutouts between neighboring tongues. The edge zone is turned radially inward and its tongues are each respectively mounted on a holding element projecting from the face side of the shell support element. Centering elements also ono the face side of the shell support element are placed each for extending into and contacting the base of the cutouts between neighboring tongues for positioning the tongues.

3 Claims, 2 Drawing Sheets

MOUNTING A PRESS SHELL TO A PRESS ROLL FOR DEWATERING A WEB

This is a division of application Ser. No. 07/267,023, filed Nov. 4, 1988 now U.S. Pat. No. 4,878,281.

BACKGROUND OF THE INVENTION

The present invention relates to a press roll which serves for treating material in web form, preferably for the removal of water from a fiber web, and which press roll forms a press nip with a mating press roll, and in particular relates to the mounting of a press shell to the press roll.

A press roll is typically used for the treatment of a web, and preferably in the dewatering of a fiber web. The press roll forms a press nip, for example, with a mating roll. The press roll includes a support body which is either stationary or is rotatable along with the roll. There is an endless beltlike, flexible, liquid tight press shell which is disposed around the support body and is supported by it. Axially outward of the support body at at least one end there is a press shell support element in the form of a disk, ring or the like, and that shell support element is rotatable, because the press shell is secured to it to rotate with it.

The press shell has at at least the one end, and preferably at both ends, an edge zone which first extends out over and past the shell support element and is then turned radially inward to be fastened to the axially outwardly facing, face side of the shell support element. The edge zone of the press shell has an annular face side sealing surface which can be pressed by a clamping flange, or the like, against the face side of the shell support element. There are distributed along the edge zone of the press shell a plurality of uniformly distributed axially outwardly projecting tongues which extend toward the axis of the press roll when the edge zone is turned inwardly. The tongues are shaped and spaced so that there is a respective cutout in the press shell between neighboring tongues.

Various centering elements may be disposed on the outwardly facing, face side of the shell support element, and these projecting centering elements extend into the cutouts between the tongues of the shell and position the shell with respect to the shell support element. In particular, the centering elements rest against the bases of the cutouts.

Holding elements are also provided, which may comprise a pin, bolt, or the like, extending out of the outwardly facing, face side of the shell support element. In an alternate embodiment, those holding elements may be defined at the annular clamping flange that clamps the edge zone of the press shell to the face side of the shell support element.

The holding elements and the centering elements are respectively radially so placed that with the tongues supported on the respective holding elements, the centering elements press into the bases of the cutouts and those centering elements tension the press shell as the tongues are tightened by being placed upon the holding elements.

The shell support elements are normally axially outwardly biased from the support body thereby to axially tension the press shell. Means for temporarily pushing the shell support elements axially inwardly against the normal outward bias are provided on the support body, and with the shell support elements pushed axially inwardly, is easier to mount to the press shell on the holding elements. Thereafter, the shell support elements are again permitted to be biased outwardly.

The invention also concerns a method of mounting the press shell on the apparatus described. The press shell is drawn over the support body and over the shell support elements, so that the edge zones are brought to extend beyond the shell support elements and are then turned radially inwardly so that the tongues extend inward and are mounted to the holding elements while the centering elements move into the bases of the cutouts between neighboring tongues. For facilitating the mounting of the press shell, the shell support elements are temporarily moved axially inwardly until the tongues are mounted to the holding elements.

Such a press roll is known from Federal Republic of Germany Published Application DE-OS No. 35 01 635, which is equivalent to U.S. Pat. No. 4,625,376.

For known press rolls, as well as for rolls according to the present invention, there are two different types of construction. In the one type, the support beam, which extends through the surrounding press shell, is stationary. In the other type, the support body is mounted for rotation in a manner similar to the press shell.

With a stationary support body that does not rotate, in the region of the press nip, the flexible belt like press shell slides over the support body in the circumferential region where the support body presses the press shell against the mating roll. A radially movable press shoe over which the press shell slides is preferably provided on the support body for this purpose, in accordance with Federal Republic of Germany Published Application DE-OS No. 33 11 996, which corresponds to U.S Pat. No. 4,555,305. The slide surface of the press shoe is usually concave, generally in accordance with the curvature of the mating roll, so that the press nip has a certain longitudinal length in the direction of travel of the web, i.e., an elongate press nip is formed. The cross-sectional shape of the support body can in this case be of any desired shape, for instance rectangular, tubular or I-shaped.

If the support body is of the type that is mounted for rotation and has the shape of a circular cylindrical roll body, then when the support body presses the press shell against the mating roll, it travels on the inside of the press shell in the region of the press nip.

In known press rolls, as well as of the press roll of the invention, the press shell is always developed liquid tight since the inside of the press shell must be wetted with lubricant, but none of the lubricant should penetrate to the outside from the inside of the press roll. If the lubricant did penetrate to the outside, there is a danger that the web to be treated would be dirtied.

For these reasons, it is also very important that the ends of the press shell be connected in absolutely liquid tight manner to the two press shell support elements, which are mounted rotatably on the support body. Furthermore, it is important that this connection can be both made and opened within a short time, because after a period of operation, it must be expected that the press shell will have to be replaced by a new one. When the press roll is used, for instance, in a paper making machine, it is important that the press shell be replaced in the shortest possible time, in order to reduce the machine standstill time as much as possible.

Furthermore, with the known press shell roll, as well as with the press roll of the invention, the press shell is preferably made of a reinforced and relatively hard plastic, for instance polyurethane. A fabric is preferably provided as reinforcement.

Known measures for liquid-tight attachment of the ends of the press shell to the shell support elements in the known press roll have proven worthwhile in practice. However, difficulties are still at times encountered in attaching a new press shell to the shell support elements within the shortest possible time. For example, during this mounting, it is important to center the ends of the press shell as accurately as possible on the shell support element, since the smooth travel of the press shell in operation depends upon this.

SUMMARY OF THE INVENTION

The object of the present invention, therefore, is to improve the press roll described above in such a manner that the centering and attachment of the ends of the press shell to the shell support elements can be carried out more dependably and faster than up to the present time.

Other objects and features will be explained below with reference to the embodiments shown in the drawings.

DESCRIPTION OF THE PREFERRED EMBODIMENTS

Figure 1:
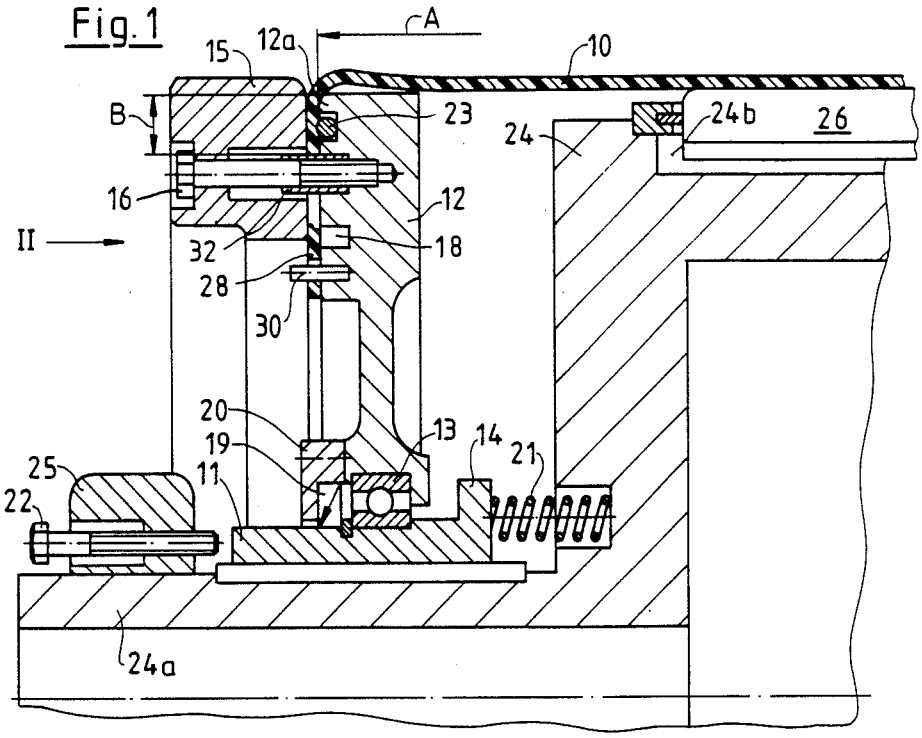
FIG. 1 shows a radial partial section through an end of a press roll with a fixed support body and a press shell support element or disc, seen along line I—I of FIG. 2
Figure 2:
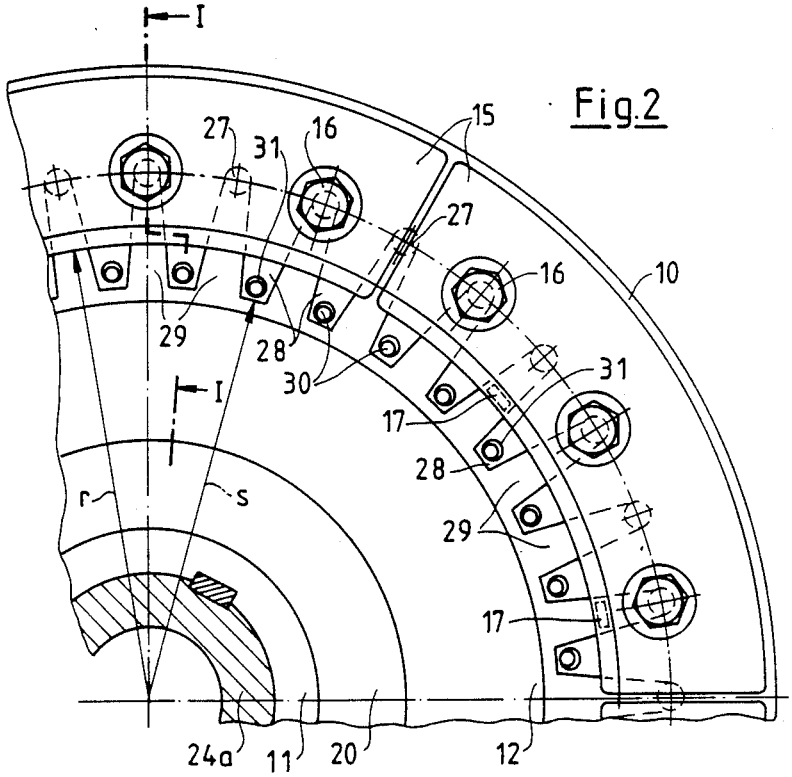
FIG. 2 shows a sector of the shell support disc seen in the direction of the arrow II of FIG. 1.

The press roll shown in FIGS. 1 and 2 has a nonrotating support body or beam 24 which is supported at its two ends, only one of which is visible. Each end of the support body rests through its journal **24*a* in a bearing block 25. On its outside, the support region of the support body is provided in known manner with a cutout region 24*b* in which a known press shoe 26 is arranged. The axial length of that shoe corresponds approximately to the width of the web of paper to be treated. An endless, tubular, press shell 10 of known construction travels around the support body 24 and over the press shoe 26. By the action (not shown) of a pressure fluid on it, the press shoe 26 can press the press shell 10 against a mating roll, like that roll 50 in FIG. 5**.

On each end of the press roll, a bearing ring 11 is mounted in an axially displaceable, but nonrotatable, manner on the axially projecting journal **24*a*. A shell support disc 12 is rotatably mounted by means of an antifriction bearing 13 on the bearing ring 11. On the axially outer face side of the shell bearing disc 12, the radially inwardly bent edge zone of the press shell 10 is fastened by means of an annular clamping flange 15 which clamps on the edge zone and screws 16 which tighten flange 15 to disc 12. In order to facilitate the mounting and clamping, the clamping flange 15 can be divided into arcuate segments of convenient size. Furthermore, the segments can have axially projecting noses 17 which fit in respective annular grooves 18 in the shell support disk 12** to position the segments.

It is desirable to seal off the inside of the press roll, which is limited by the press shell 10 and the shell support discs 12, from the outside. For this purpose, the press shell 10 essentially is comprised of a liquid tight plastic, for instance, polyurethane. That plastic material is preferably reinforced with a support fabric which is formed in known manner of both circumferential and longitudinal threads. The axially outer face side of the shell support disc 12 and the overlapped edge zone of the press shell 10 together form a pair of sealing surfaces having the width B in FIG. 1. In order to assure tightness and seal with still greater certainty, an annular groove can be provided in the outer face of the shell support disc, with an O sealing ring 23 contained in the groove. Finally, on the outside of the antifriction bearing 13, there is provided a shaft packing ring 19 which rests in a housing ring 20 fastened to the shell support disc 12.

For axially tensioning the press shell 10, compression coil springs 21 are clamped between the support body or beam 24 and a flange 14 of the bearing ring 11. To facilitate the mounting of the press shell 10, the bearing block 25 has at least one pressure screw 22. By means of that screw, the bearing ring 11, together with the shell support disc 12, can be pushed temporarily somewhat closer to the support body 24.

Figure 3:
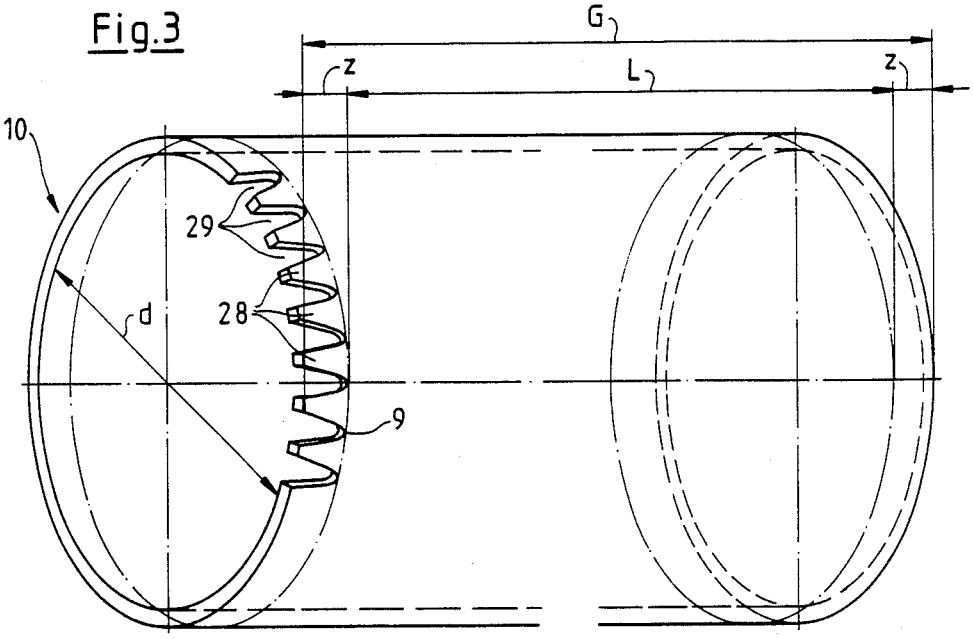
FIG. 3 shows the press shell by itself in an oblique view.

FIG. 3 shows the condition of the press shell 10 before it has been pulled onto the support member 24. In this case, it has an elongate, approximately cylindrical, basic shape. The two axial ends are formed with numerous approximately triangular cutouts 29, which are circumferentially spaced and have such an internal angle that approximately trapezoidal tongues 28 remain, each extending in a direction parallel to the axis of the press shell. Instead of the trapezoidal tongues, however, rectangular cutouts may be formed to define rectangular tongues (not shown). For simplification of the drawing, the press shell has been shown in FIG. 3, in oblique view, as a circular cylinder. Actually, in view of the flexibility of its material, its cross-section will deviate to a greater or lesser extent from a circular shape The circumferential length of the inside of the press shell (corresponding to the inside diameter d shown in FIG. 3) is selected to be large enough that there will be a certain radial distance present between the press shell and the support body 24. Furthermore, as a rule, the outside diameter of the shell support discs 12 will be selected to be slightly smaller than the inside diameter d of the press shell 10. In this way, during its installation on the support body, the press shell 10 can be pulled over the support body 24 and the shell support discs 12 with the exertion of only slight force.

The length L of the main part of the press shell which is free of cutouts 29 depends on the approximate distance A (FIG. 1) between the outer face surfaces of the shell support discs 12 and the width B of their sealing surfaces Due to the aforementioned displaceability of the bearing ring 11, the distance A can be varied. The length z of the tongues 28 of the press shell, and thus the total length G of the press shell 10, is also selected so that the tongues 28 in the final mounted condition of the press shell extend radially inward beyond the radially inward edge of the clamping flange 15. This assures that the distance s from the axis of the press roll to the free ends of the tongues 28 is less than the distance r from the axis of the press roll to the radially inner limitations of the clamping flange 15 (FIG. 2).

For transforming the press shell 10 from the elongated shape shown in FIG. 3 into the shape shown in FIGS. 1 and 2, in which the edge zones of the part of the press shell having the length L extend inward in the manner of a flange and form a smooth sealing surface, the following procedure is employed.

The clamping flange segments 15 are either removed entirely from or are set to the greatest possible distance from the shell support discs 12. One tongue 28 after the other (or simultaneously two tongues lying radially opposite each other in pairs) is (or are) bent over radially inward around the rounded outer edge or corner 12*a* of the shell support disc 12. At the tip of each tongue 28 there is a tongue mounting hole 31.

Located radially to the inside of the screws 16 i.e., in the radial region between the screws 16 and the center line of the press roll, a bolt or a cylinder pin 30 is provided in the shell support disc 12 for mounting each tongue 28. This bolt or pin extends approximately parallel to the axis of the roll or is slightly inclined toward the center axis from the outer face side of the shell support disc 12. Preferably, each tongue 28 is mounted on a respective cylindrical pin or bolt 30. Tensile forces are exerted, by means of the large number of tongues, around the entire edge zone of the press shell so that the three-dimensionally curved shape of the edge zone shown in FIG. 1 is formed. In this connection, the material is compressed in the circumferential direction in the region of the width B of the sealing surface, while the material bulges somewhat bead-like outside the sealing surface.

As seen in FIG. 2, each projection 27, which is in the form of a bolt, is arranged in the outer face side of the shell support disc 12 between two screws 16. The number of screws 16 and of bolts 27 together is equal to the number of tongues 28 and cutouts 29, respectively. The arrangement of the screws 16 and bolts 27 is selected so that they fit precisely into the bottoms of the cutouts 29. Preferably, the screws 16 and the bolts 27 are arranged on the same pitch circle so that the depth z (FIG. 3) of all the cutouts 29 can be made the same. However, one can also deviate from this. It is also advantageous, as shown in FIG. 2, to provide the same number of screws 16 and bolts 27 and distribute them alternatingly around the circumference. Furthermore, it is advisable to insert one sleeve 32 into each of the threaded bores intended for the screws 16, and to make the outside diameter of the sleeves 31 and the bolts 27 the same. In this way, all cutouts 29 of the press shell 10 can be shaped the same.

With the above described reshaping of the edge zone of the press shell 10, the tongues 28 are pulled radially inward so far in the direction of the axis of the roll that the base 9 (FIG. 3) of the cutouts 29 rests against the bolts 27 and against the sleeves 31. This very rapidly provides a centered seat of the press shell 10, and thus good concentric travel in operation. After placing all of the tongues onto their cylindrical pins 30, the edge zone of the press shell 10 is clamped between the shell support disc 12 and the clamping flange 15 by tightening the screws 16. Finally, a pressure screw 22 is loosened from the bearing ring 11, which frees that ring to move outward so that the compression springs can tension the press shell 10 in the axial direction. An alternate technique, described further in connection with FIG. 5, of securing the tongues 28 is to provide projections on the inside of the clamping flange 15 and corresponding holes in the tongues to receive those projections, wherein the holes are placed so that the projections hold and uniformly and adequately tension the press shell axially.

Figure 4:
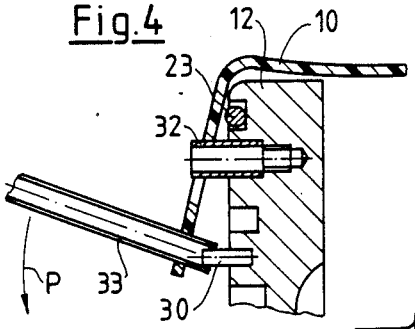
FIG. 4 shows an intermediate stage during the mounting of the press shell of the roll shown in FIGS. 1 and 2.

FIG. 4 shows how each of the tongues 28 can be pulled in the direction toward the axis of the press roll by means of a tubular tool 33 which acts like a lever. FIG. 4 shows the shell support disc 12 with the sealing ring 23, one of the sleeves 32 and one of the cylindrical pins 30. The clamping flange segments 15 and their fastening screws 16 are removed. The tool 33 is passed through the hole 31 at the tip of the tongue 28 and is placed onto the cylindrical pin 30 which then serves as its fulcrum. The tool 33 can now be swung toward the axis of the roll in the direction indicated by the arrow P and the tongue 28 is then pushed onto the cylindrical pin 30.

This method has various advantages over the previous method described in Federal Republic of Germany Application DE-OS No. 35 01 635 (U.S. Pat. No. 4,625,376). The tension springs, which previously had to be removed after the mounting and clamping by arcuate clamping segments was concluded, are no longer necessary. The mounting can therefore be effected in a shorter period of time. It further leads with greater certainty than previously to accurate centering of the press shell.

Figure 5:
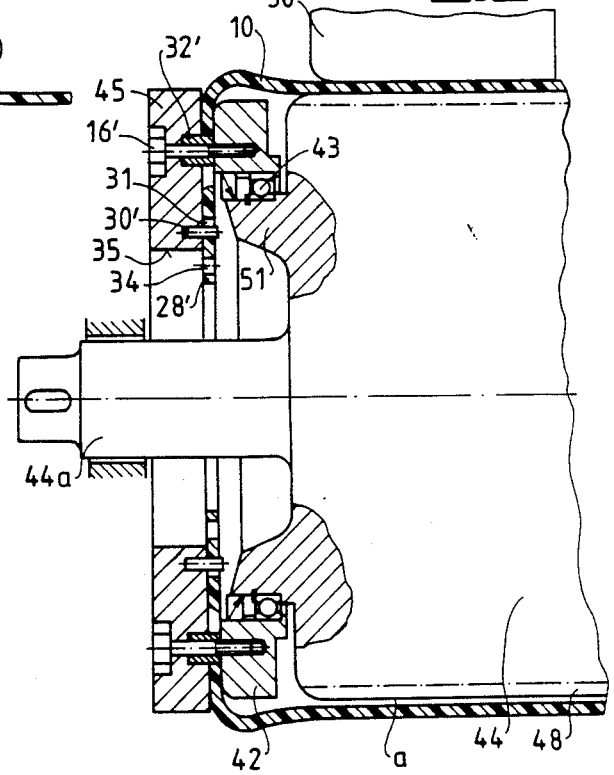
FIG. 5 shows an example of a press roll with a rotating support body and a shell support ring.

FIG. 5 shows the use of the invention on a press roll which is rotatable as a whole unit and which has a loose covering in the form of the above described press shell 10. Differing from the other embodiment, the support body 44 is a rotatably mounted and circular-cylindrical roll body 44. The journal 44*a* of that body can, if necessary, be connected to a drive. The basic shape of the press shell 10 is the same as shown in FIG. 3. The liquid tight closing off of the inner space defined by the press shell 10 could, in principle, be developed in the same way as in FIGS. 1 and 2, that is with a bearing ring 11 displaceable on the journal 44*a* and a shell support disc 12 mounted thereon. Differing from this, in FIG. 5 a bearing ring 51 is developed on the roll body 44. An annular shell support element, concentric to the roll body 44, is mounted by an antifriction bearing 43 and a sealing ring 49 on the ring 51. On the outer face surface of the shell support element 42, the press shell 10 is fastened by clamping ring 45 and screws 16'. This attachment and the preceding shaping of the press shell 10 are effected in a similar manner to that described above with reference to FIGS. 1 to 4.

For centering the press shell 10, sleeves 32' are provided as in FIG. 1, but these sleeves are inserted, in accordance with FIG. 5, in the clamping flange 45. Different from FIG. 1, the cylindrical pins 30', which serve for the clamping of the tongues 28, are inserted into and extend axially into the tongues from the clamping flange The tongues 28' are longer and/or extend slightly further in the direction toward the axis of the roll than the tongues in FIG. 1. In this way, it is possible to provide two holes 31 and 34 in each tongue. A tool (not shown) like a post, can be connected to the hole 34 present in the tip of the tongue. That tool is rested against the inner shell surface. By means of the tool, the tongue 28' can be pulled in the direction toward the axis of the roll until the tongue can be placed, via the hole 31 located radially outward further toward the inside of the shell 35, onto the cylindrical pin 30'. It is evident that this method can be employed also in the case of the structural form with stationary support member shown in FIGS. 1 and 2.

At the top of FIG. 5, a small portion of a mating roll 50 can be noted. It forms a press nip with the press roll. Circumferentially outside the press nip, there is a small distance a between the press shell 10 and the roll body 44 because the inside diameter d (FIG. 3) of the press shell 10 is greater than the outside diameter of the roll body 44. Axial tensioning of the press shell 10 has been dispensed with in FIG. 5. If necessary, however, the bearing ring 51 can be made axially displaceable relative to the roll body 44.

The roll body 44 in FIG. 5 can be entirely metallic and can be without the firm covering, for instance, of rubber, plastic, or the like, which as frequently been necessary. The function of that covering is now assumed by the press shell 10, which rotates loosely with the roll body. On the other hand, to obtain special effects upon passage of the web to be treated through the press nip, there is the possibility of providing the roll body 44 in addition with a firm covering 48, as indicated in dot-dash lines, in FIG. 5. There are many possible variations, in this connection, through selection of specific pairings of materials for the press shell 10 and the firm covering 48.

The conduits for feeding and removing lubricating and/or cooling liquid, for instance, for the cooling of the roll body 44, which are generally necessary, have been omitted in all of the Figures. The lubrication of the inside of the press shell 10, particularly upon its passage through the press nip, is indispensable in the case of a stationary support body 24, 26 (FIG. 1). However, it may also be advisable in the case of a rotating support body as in FIG. 5. If lubrication of the press shell is dispensed with in the case of FIG. 5, then a liquid tight closing off of the inside is nevertheless still advantageous to avoid the penetration of water, and the resulting corrosion.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A method for attaching a press shell to a press roll, wherein the press roll comprises:

a support body having a support area on its periphery and also having longitudinal axis and a longitudinally axially outward end;

a press shell support element located outward of the support body in the longitudinally axial direction of the support body;

the support element having an outer side face facing away from the support body;

a flexible, liquid impervious press shell disposed around the support body for being supported by the support area and also being disposed around the support element, the press shell having an edge zone; a plurality longitudinally axially outwardly projecting tongues defined on the edge zone and arrayed around the edge zone;

the press shell being of sufficient width to extend longitudinally axially beyond the axially outward end of the support body and to extend longitudinally axially outwardly beyond the outer side face of the shell support element and to be turned radially inwardly around the side face of the shell support element;

the method comprising:

disposing the press shell around the support body and moving the press shell so that the edge zone thereof extends longitudinally axially outward of the side face of the shell support element;

drawing the edge zone of the press shell radially inwardly over the side face of the shell support element by engaging each of the tongues of the press shell and moving each tongue radially inwardly and securing each tongue on a respective press shell holding element which projects out of the side face of the shell support element; and thereafter clamping the edge zone of the press shell to the side face of the shell support element radially outward of the holding element.

2. The method of claim 1, wherein neighboring tongues are separated by cutouts, and each cutout extends from the outer ends of the neighboring tongues to the bases of the cutouts, further comprising when drawing the tongues radially inwardly to the holding elements, pulling the tongues past radially more outward centering elements which project from the side face of the suppport element, such that the bases of the cutouts between neighboring tongues are drawn over the centering elements projecting from the side face of the shell support element for positioning the tongues for proper securing of the tongues to the respective holding elements.

3. The method of claim 1, further comprising moving the shell support element longitudinally axially a distance toward the longitudinally axially outward end of the support body for enabling the tongues to be drawn inwardly and mounted upon the respective holding elements, and afterward biasing the shell support element to move longitudinally axially away from the support body for longitudinally axially tensioning the press shell longitudinally axially pulling outwardly upon the edge zone thereof.

* * * * *